US006208268B1

(12) United States Patent
Scarzello et al.

(10) Patent No.: US 6,208,268 B1
(45) Date of Patent: Mar. 27, 2001

(54) VEHICLE PRESENCE, SPEED AND LENGTH DETECTING SYSTEM AND ROADWAY INSTALLED DETECTOR THEREFOR

(75) Inventors: John F Scarzello, Columbia; Daniel S. Lenko, Monrovia; Adam C. Feaga, Clarksville, all of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 08/054,166

(22) Filed: Apr. 30, 1993

(51) Int. Cl.[7] ..... G08G 1/01

(52) U.S. Cl. ..... 340/941; 340/940; 340/933; 324/247; 324/207.26; 324/174; 324/179; 364/565; 364/438

(58) Field of Search ..... 340/941, 933, 340/906, 938, 936, 939, 940; 324/247, 207.14, 207.23, 207.24, 207.26, 173, 174, 175, 179; 364/565, 438, 436; 361/156, 180; 180/282

(56) References Cited

U.S. PATENT DOCUMENTS

| | | | | |
|---|---|---|---|---|
| 3,614,729 | | 10/1971 | Fujimoto | 340/933 |
| 3,626,413 | | 12/1971 | Zachmann | 340/933 |
| 3,641,569 | | 2/1972 | Bushnell et al. | 340/38 L |
| 3,778,761 | | 12/1973 | Cribbins | 340/933 |
| 3,877,666 | * | 4/1975 | Itakura et al. | 246/122 R |
| 3,983,531 | | 9/1976 | Corrigan | 340/31 R |
| 4,234,923 | | 11/1980 | Eshraghian et al. | 364/436 |
| 4,302,746 | | 11/1981 | Scarzello et al. | 340/38 L |
| 4,356,489 | | 10/1982 | Hirota et al. | 343/7 VM |
| 4,368,428 | | 1/1983 | Dijkman | 340/936 |
| 4,767,988 | | 8/1988 | Wilson | 324/247 |
| 4,920,340 | | 4/1990 | Mizuno | 340/933 |
| 4,943,805 | | 7/1990 | Dennison | 340/933 |
| 4,968,979 | | 11/1990 | Mizuno et al. | 340/941 |
| 5,008,666 | | 4/1991 | Gebert et al. | 340/936 |
| 5,091,697 | | 2/1992 | Roth et al. | 324/247 |
| 5,113,136 | | 5/1992 | Hayashi et al. | 324/247 |
| 5,206,642 | * | 4/1993 | Gregoire et al. | 340/933 |
| 5,331,276 | * | 7/1994 | Polvani et al. | 340/941 |

* cited by examiner

*Primary Examiner*—Nina Tong
(74) *Attorney, Agent, or Firm*—John Forrest; Jacob Shuster

(57) ABSTRACT

An improved detector is provided for installation in a roadway surface. The detector finds utility in a highway vehicle detection system for determining vehicle presence, vehicle speed and vehicle length. First and second matched induction coil magnetic sensors are maintained at or near the roadway surface. Each of the sensors has a longitudinal axis aligned normal to the roadway surface. The first and second sensors are separated from one another by a known distance in a direction substantially aligned with a direction of traffic flow. Each of the sensors generate a differential magnetic field signature with respect to time to indicate a passing vehicle's leading and trailing edge magnetic signatures. Vehicle speed is determined by a time-distance relationship using the leading and trailing edge magnetic signatures and the known distance. Vehicle length is determined by a time-speed relationship using the leading and trailing edge magnetic signatures and the determined vehicle speed. A triaxial magnetometer maintained at a location in close proximity to the first and second sensors measures a DC magnetic field. The DC magnetic field has vertical and horizontal magnetic field components with the horizontal components including a component substantially aligned with the direction of traffic flow and a component substantially perpendicular to the direction of traffic flow. The vertical and horizontal components caused by the passing vehicle are used to determine vehicle presence. An ELF communications system may be incorporated with the detector to link roadside and vehicle transmitted/received information.

31 Claims, 2 Drawing Sheets

Figure 1:
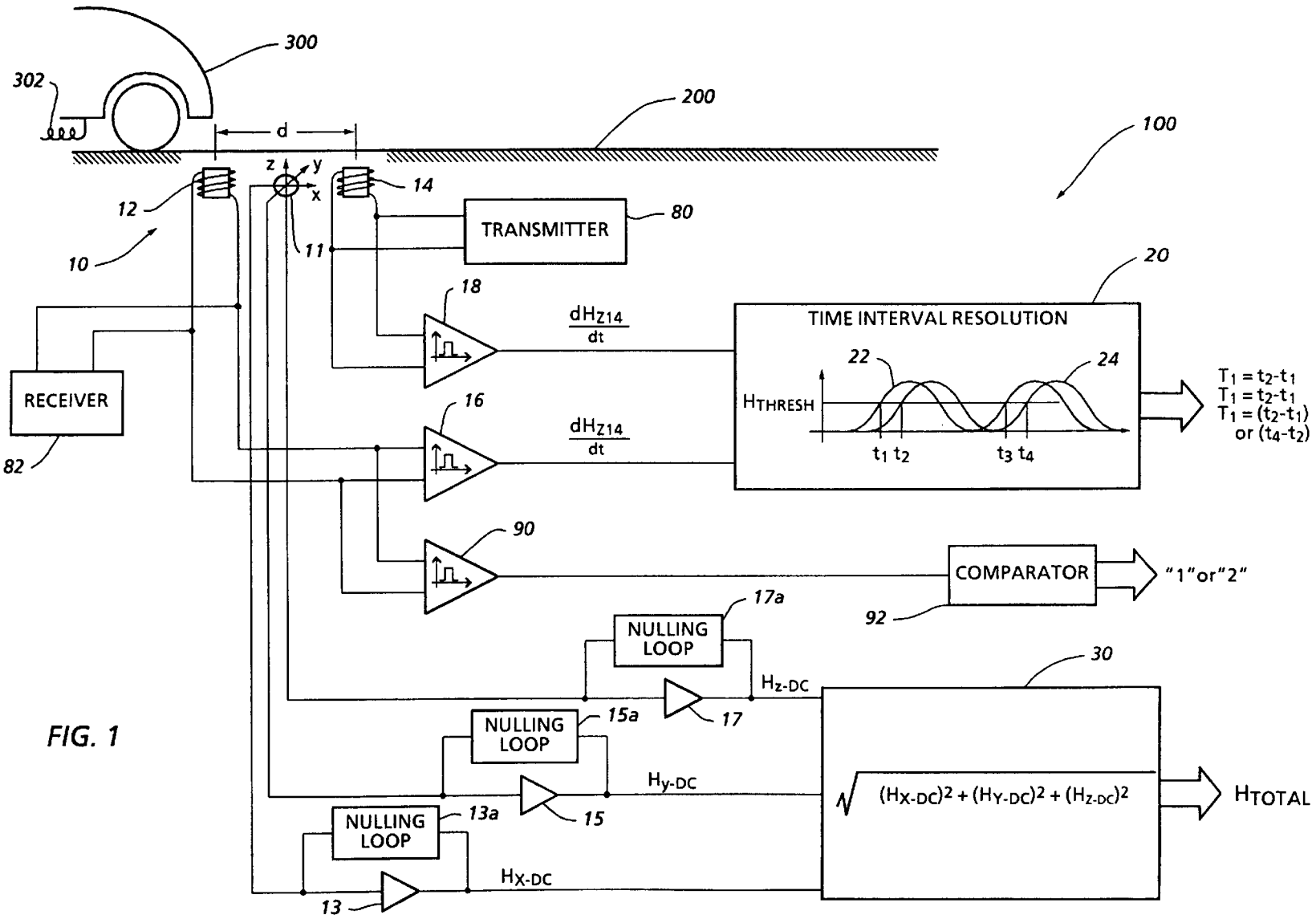

VEHICLE PRESENCE, SPEED AND LENGTH DETECTING SYSTEM AND ROADWAY INSTALLED DETECTOR THEREFOR

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to highway vehicle sensing systems, and more particularly to a magnetic roadway installed detector and system capable of detecting the presence of a motor vehicle and accurately determining the vehicle's speed and length.

BACKGROUND OF THE INVENTION

Vehicle detectors are key components in all street and freeway traffic control and surveillance systems. An ideal detector for these applications should be low in cost, provide accurate detection, require minimum installation time and cost, be reliable under all environmental conditions, have low maintenance and calibration requirements, and be able to detect all vehicles on any standard roadway surface.

The United States Navy has developed and patented (U.S. Pat. No. 4,302,746) a self-powered vehicle detection (SPVD) system for the Federal Highway Administration. The SPVD system detector includes a two-axis magnetometer that measures a motor vehicle's magnetic signature. The signature is processed to determine vehicle presence and is then transmitted to a road-side receiver system. The operating principle of the SPVD is to sense the magnetic field of the vehicle and transmit a leading and trailing edge signals corresponding to magnetic signature threshold levels. Since the magnetic field signature amplitudes vary with respect to the size and shape of motor vehicles, the speed of a motor vehicle must be determined using two precisely spaced SPVD detectors or other current state of the art speed sensors (eg., loop detectors). Unfortunately, the process of burying a plurality of SPVD detectors and/or loop detectors in a roadway is time consuming and costly.

In addition, the amount of magnetic material used in motor vehicles has decreased over the last ten years. A recently built motor vehicle's magnetic field signature amplitude is less than that of a comparably sized motor vehicle built a decade ago. Therefore, today's highway vehicle sensing system based on magnetic field signatures requires a greater sensitivity to detect smaller amplitude magnetic signatures.

SUMMARY OF THE INVENTION

Accordingly, it is an object of the present invention to provide a highway vehicle sensing system for detecting the presence and speed of a passing vehicle.

Another object of the present invention is to provide a highway vehicle sensing system that minimizes roadway surface disturbances in order to install the system's roadway detector.

Yet another object of the present invention is to provide a magnetic highway sensing system for sensing vehicle magnetic signatures with an improved sensitivity to magnetic field strength.

Other objects and advantages of the present invention will become more obvious hereinafter in the specification and drawings.

In accordance with the present invention, an improved detector is provided for installation in a roadway surface. The detector finds utility in a highway vehicle detection system for determining vehicle presence, vehicle speed and vehicle length. First and second matched induction coil magnetic sensors are maintained at or near the roadway surface. Each of the sensors has a longitudinal axis aligned normal to the roadway surface. The first and second sensors are separated from one another by a known distance in a direction substantially aligned with a direction of traffic flow. Each of the sensors generate a differential magnetic field signature with respect to time to indicate a passing vehicle's leading and trailing edge magnetic signatures. First, second and third time intervals associated with the leading and trailing edge magnetic signatures are used in conjunction with the known distance to determine vehicle speed and vehicle length. Specifically, the first time interval occurs between the passing vehicle's leading edge magnetic signatures detected by the first and second sensors, the second time interval occurs between the passing vehicle's trailing edge magnetic signatures detected by the first and second sensors, and the third time interval occurs between the passing vehicle's leading and trailing edge magnetic signatures detected by one of the first and second sensors. Vehicle speed is determined by a time-distance relationship using at least one of the first and second time intervals and the known distance. Vehicle length is determined by a time-speed relationship using the third time interval and the determined vehicle speed.

A triaxial magnetometer maintained at a location in close proximity to the first and second sensors measures a DC magnetic field. The DC magnetic field has vertical and horizontal magnetic field components with the horizontal components including a component substantially aligned with the direction of traffic flow and a component substantially perpendicular to the direction of traffic flow. The vertical and horizontal components caused by the passing vehicle are used to determine vehicle presence.

In addition, third and fourth matched induction coil magnetic sensors may be provided and maintained at or near the roadway surface in close proximity to the first and second sensors. Each third and fourth sensor lies in a unique horizontal plane and has a longitudinal axis aligned substantially parallel to the roadway surface. The third and fourth sensors form an orthogonal crossing pattern when viewed with respect to a direction normal to the roadway surface. The orthogonal crossing pattern is arranged so that each of the third and fourth sensor's longitudinal axis bisects the direction of traffic flow by an angle of approximately 45°. The third and fourth sensors may be used to transmit and/or receive extremely low frequency (ELF) (generally 30–300 Hz) signals to/from the passing vehicle or a remotely located roadside control unit.

BRIEF DESCRIPTION OF THE INVENTION

Figure 2:
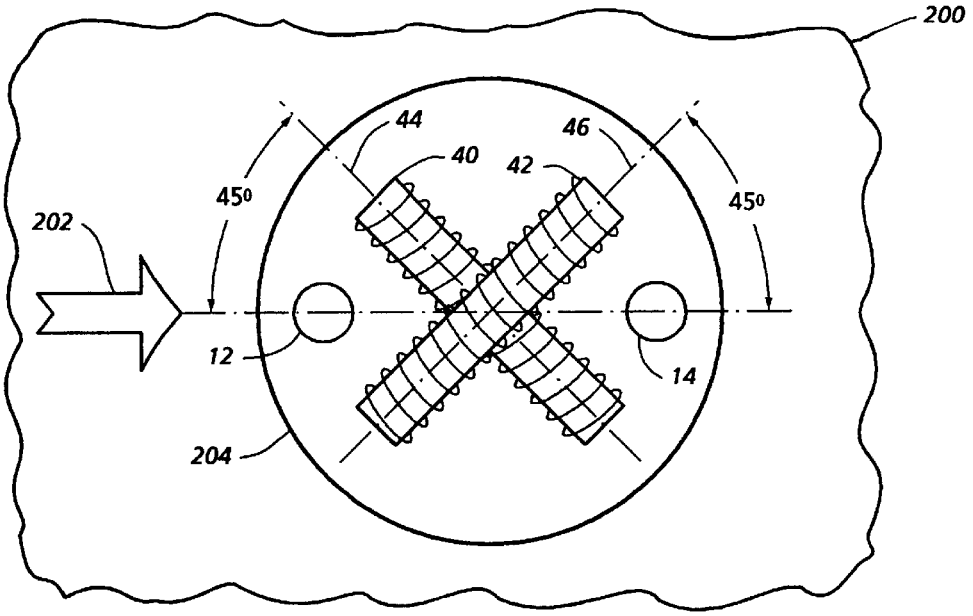
Figure 3:
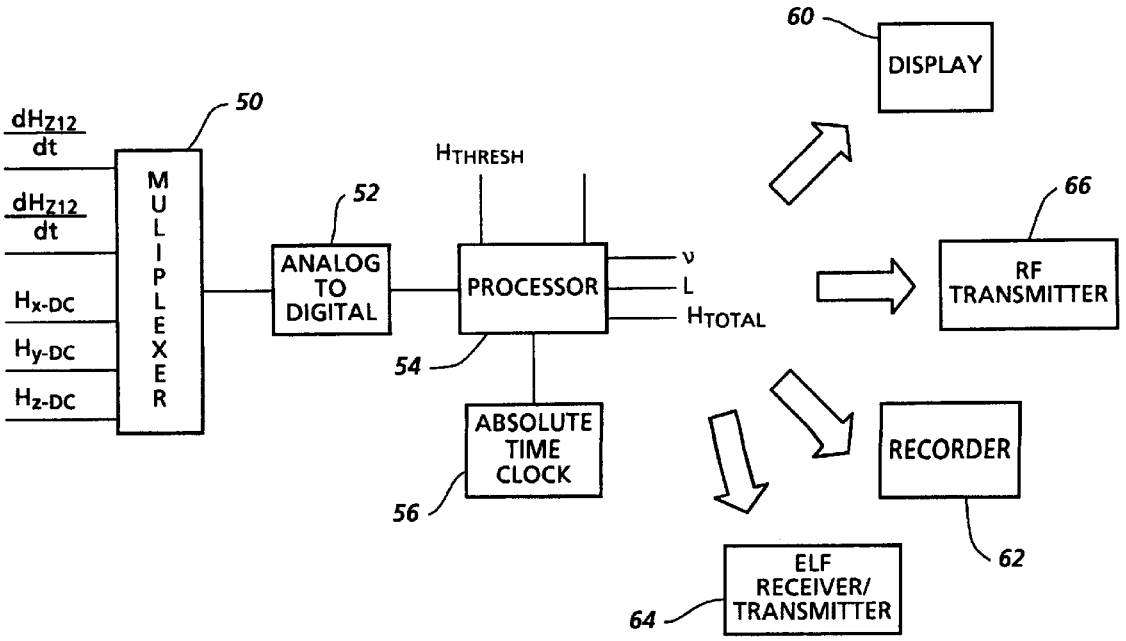

FIG. 1 is a block diagram of the vehicle presence, speed and length detecting system utilizing a roadway installed detector in accordance with the present invention;

FIG. 2 is a top view of the roadway installed detector showing in isolation a pair of orthogonally crossed induction coil magnetic sensors serving as a dedicated ELF transceiver for communication with an ELF transceiver mounted on the passing vehicle; and FIG. 3 is a block diagram of an example of a digital processing system used to process magnetic field measurements from the roadway installed detector of the present invention.

DETAILED DESCRIPTION OF THE INVENTION

Referring now to the drawings, and more particularly to FIG. 1, the vehicle presence, speed and length detecting system according to a preferred embodiment of the present invention is shown in block diagram form is designated generally by reference numeral 100. A detector 10 is installed at or near a roadway surface 200 and is typically counter-sunk beneath the roadway surface as shown. Detector 10 includes two matched induction (ferrite) coil magnetic sensors 12 and 14, and a triaxial fluxgate magnetometer 11 shown with its coordinate system Induction coil sensors 12 and 14 have their longitudinal axes aligned substantially perpendicular to roadway surface 200 so that adjacent lane (y-direction) vehicle magnetic signatures have little influence on the measured magnetic signal amplitude. Sensors 12 and 14 are separated by a small distance l in a direction that is substantially aligned along the x-direction, i.e., the direction of normal traffic flow on roadway surface 200. For purposes of the present invention, it is sufficient that separation distance l is some fraction of the shortest vehicle length that is to be detected. However, practically speaking, the choice of separation distance l is predicated on the desire to minimize the amount of roadway surface disturbance required for the installation of detector 10. Indeed, one of the advantages of the present invention is that detector 10 provides for installation via a single bore hole that is only 4 to 6 inches in diameter.

Sensors 12 and 14 are sensitive to magnetic field changes in the vertical or z-direction with respect to roadway surface 200. Thus, as a motor vehicle 300 passes over detector 10, each sensor detects the changes in the vertical magnetic field caused by passing vehicle 300. Mathematically, each sensor is sensitive to the differential $$\frac{dH_z}{dt} \tag{1}$$

where $$\left|\frac{dH_{z12}}{dt}\right|, \left|\frac{dH_{z14}}{dt}\right|$$

designate the change in the vertical magnetic field over the separation distance l in the x-direction during the time it takes (dt) for vehicle 300 to pass respective sensors 12 and 14.

In order to filter out interference, the differential magnetic field signatures from sensors 12 and 14 are passed through respective and identical bandpass filter/amplifiers 16 and 18. The resulting output from filter/amplifiers 16 and 18 are vertical magnetic signature versus time signals shown graphically as curves 22 (from filter/amplifier 16) and curve 24 (from filter/amplifier 18) in a time interval resolution block 20. Since sensors 12 and 14 are closely spaced, matched induction coils whose output passes through identical filter/amplifiers, curves 22 and 24 will be essentially identical but time shifted. Based on this structure, vehicle speed and length can be accurately determined when combined with vehicle presence determined by triaxial magnetometer 11.

As a basis for determining vehicle speed and length, time intervals related to the measured vertical magnetic signatures must be accurately determined. A threshold level $H_{THRESH}$ is set as a magnetic field magnitude minimum in the z-direction for triggering time interval resolution. Typically, $H_{THRESH}$ is set at a level low enough to detect passing vehicles whose size is of interest (eg., may be set to only detect tractor trailers) and yet high enough to discriminate against passing vehicles of little interest (eg., may be set to ignore bicycles). For a vehicle of interest, $H_{THRESH}$ is passed four times as vehicle 300 passes over detector 10. Specifically:

—$t_1$ is the point in time at which the leading edge of vehicle 300 crosses sensor 12;

—$t_2$ is the point in time at which the leading edge of vehicle 300 crosses sensor 14;

—$t_3$ is the point in time at which the trailing edge of vehicle 300 crosses sensor 12; and —$t_4$ is the point in time at which the trailing edge of vehicle 300 crosses sensor 14.

The following three time intervals of note $T_1$, $T_2$ and $T_3$ may be generated from points $t_1$ through $t_4$. Specifically:

$$T_1=t_2=t_1 \tag{2}$$

$$T_2=t_4-t_3 \tag{3}$$

$$T_3=t_3-t_1 \text{ or } t_4-t_2 \tag{4}$$

Since separation distance l is known, vehicle speed at may be easily determined by the time-distance relationship $$v_{12} = \frac{l}{T_1} \tag{5}$$

Further, since curves 22 and 24 are essentially identical but shifted in time in accordance with separation distance l, vehicle speed can be determined by the relationship $$v_{34} = \frac{l}{T_2} \tag{6}$$

Recalling that separation distance l is only a fraction of vehicle length (and typically on the order of 4 inches), it can be assumed that vehicle speed at sensors 12 and 14 is essentially unchanged as vehicle 300 passes thereover. Thus, detector 10 provides a single point 8 (ie., single bore hole) installation that not only detects vehicle speed but also provides a near instantaneous verification of same when combined with the indication of vehicle presence derived from the output of triaxial magnetometer 11.

Once again, since vehicle speed is essentially the same when the vehicle approaches and leaves detector 10, vehicle length L may be determined from the straight forward time-speed relationship $$L=vT_3 \tag{7}$$

Here, v is vehicle speed (either $v_{12}$ or $V_{34}$) as determined above and time interval $T_3$ represents the time that it takes the leading and trailing edge of vehicle 300 to cross sensor 12 ($t_3-t_1$) or sensor 14 ($t_4-t_2$).

Detector 10 further includes triaxial magnetometer 11 maintained in close proximity to sensors 12 and 14. Practically, "close proximity" means within the same bore hole in roadway surface 200. One such magnetometer and related circuitry suitable for this purpose is a Brown-type, ring-core fluxgate magnetometer described in U.S. Pat. No. 4,447,776, "Pulse Driver for Fluxgate Magnetometer" and U.S. Pat. No. 4,384,254, "Oscillator Driver Circuit for Fluxgate Magnetometer", the disclosures of which are herein incorporated by reference.

Triaxial magnetometer 11 is a DC device that measures the entire DC magnetic field in each of the x, y and z-directions. Magnetometer 11 is an absolute field measuring device that includes the earth's ambient magnetic field. In order to view of DC magnetic field caused by passing vehicle 300 with the proper sensitivity, it is necessary to remove the earth's ambient magnetic field. Accordingly, nulling loops 13*a* and 15*a* and 17*a* are included with respective amplifiers 13, 15, 17 to remove the earth's magnetic field in each of the x, y and z directions. The resulting DC magnetic field components $H_{x\text{-}DC}$, $H_{y\text{-}DC}$ and $H_{z\text{-}DC}$ are used to determine a total DC magnetic field magnitude at block 30 where $$H_{TOTAL} = \sqrt{(H_{x-DC})^2 + (H_{y-DC})^2 + (H_{z-DC})^2} \tag{8}$$

The nulling out process and apparatus to achieve same are described in detail for a two-axis magnetometer in U.S. Pat. No. 4,302,746, "Self-Powered Vehicle Detection System", the disclosure of which is hereby incorporated by reference. Extension of this apparatus to three axes is straightforward and would be well understood by one of ordinary skill in the art.

Using a magnetometer that is three-dimensionally sensitive provides two distinct advantages. First, the y-direction field component gives an indication of adjacent lane vehicle contribution. Second, knowledge of adjacent lane contribution allows for an increase in gain or sensitivity in the x and z-directions. Thus, $H_{TOTAL}$ from the triaxial magnetometer provides an improvement in the detection of vehicle presence. Further, $H_{TOTAL}$ can be compared with vehicle length L to identify the type of passing vehicle. For example, a large value for $H_{TOTAL}$ is indicative of a vehicle with a great deal of magnetic material such as a tractor trailer. In contrast, small sports cars which are constructed with little magnetic material produce smaller magnetic signatures. Discrimination between these two types of vehicles may be determined by evaluating $H_{TOTAL}$ in light of vehicle presence and vehicle length.

To further use the present invention as a tool in vehicle identification, the alternating magnetic (AM) field signature associated with vehicle 300 may be monitored using either sensor 12 or sensor 14. Detecting the AM field of a passing vehicle equates simply to determining if a specified source of an AM field is present. Sources of such AM fields are generally in the frequency range of 20–200 Hz and may include ignition noise indicative of a gas powered vehicle or noise from rotating magnetic components such as a drive shaft. For example, to monitor a specified AM field such as ignition noise, induction sensor 12 is connected to an AM field bandpass amplifier 90 and comparator 92. Bandpass amplifier 90 passes only the frequency range associated with vehicle ignition noise. Comparator 92 compares the bandpasse signal with a reference that is equivalent to an AM signature indicative of ignition noise. Accordingly, the output of comparator 92 might be a digital "1" indicating a match at comparator 92 (ie., ignition noise detected indicative of a gas powered vehicle) or a digital "0" indicating no match at comparator 92 (ie., no ignition noise indicative of a diesel powered vehicle). Additional bandpass amplifier/comparator combinations may be used to detect other specified sources of AM signatures in a similar fashion.

In addition, because sensors 12 and 14 are ferrite coil sensors, sensors 12 and 14 can be used as an ELF transmitting antenna as well as an ELF receiving antenna. For example, sensor 14 might be used to transmit ELF signals from ELF transmitter 80 to an ELF transmitter/receiver 302 mounted on vehicle 300. Alternatively, a transmitter/receiver might be located in a roadside station (not shown). Data transmitted to vehicle 300 in this way might include location, road conditions, etc. Sensor 12 could be used to receive ELF transmissions from transmitter/receiver 302 and pass same on to receiver 82 which may be located locally or remotely. Data transmitted to sensor 12 in this way might include identification of the vehicle for toll purposes, an emergency help required call, vehicle location, etc.

Alternatively, a dedicated ELF transceiver may be provided via an additional pair of matched induction (ferrite) coils 40 and 42 whose arrangement is shown in isolation in FIG. 2 as a top view of a section of roadway surface 200. Coils 40 and 42 each lie in a unique horizontal plane that is substantially parallel to roadway surface 200. Further, when viewed from above as shown, coils 40 and 42 orthogonally cross one another such that their respective longitudinal axes 44 and 46 bisect the direction of normal traffic flow (arrow 202) at an angle of 45°. Arranging coils 40 and 42 in this fashion provides an ELF transmitting/receiving unit that is omni-directional. Further, this arrangement minimizes magnetic distortion effects on the magnetic signatures detected by sensors 12 and 14 and the triaxial magnetometer (not shown in FIG. 2 for purposes of clarity). In keeping with the single point installation philosophy of the present invention, coils 40 and 42 are installed in the same bore hole 204 as sensors 12 and 14 and the triaxial magnetometer. Typically, coils 40 and 42 are centered between sensors 12 and 14 just beneath roadway surface 200. The advantage of using the separate (orthogonal and horizontal) ELF receiver/transmitter coils is that signal strength is increased resulting in greater telemetry link range.

Processing of the signals produced at detector 10 may proceed in a variety of well known analog or digital fashions. By way of example, FIG. 3 shows a digital processing system in block diagram form for accomplishing the time resolution interval block 20 and the determination of the total DC magnetic field $H_{TOTAL}$ at block 30 in FIG. 1. In terms of time interval resolution, the differential magnetic fields are multiplexed at multiplexer 50, time sampled by an analog-to-digital converter 52 and processed by a processor 54 to generate vehicle speed v and vehicle length L. Specifically, processor 54 is provided with separation distance l and the threshold value $H_{THRESH}$ used to trigger time interval resolution. Such threshold detection may be accomplished in hardware or software by means that are well known in the art and is therefore not a limitation on the present invention. An absolute time clock 56 may also be provided as a means of time stamping the incoming data for archiving purposes. In terms of the total DC magnetic field, the components $H_{x\text{-}DC}$, $H_{y\text{-}DC}$ and $H_{z\text{-}DC}$ are simply operated on by processor 54 to generate $H_{TOTAL}$. Further processing of vehicle speed v, vehicle length L and $H_{TOTAL}$ (as an indication of vehicle presence) may include, but is not limited to, transfer via wire or optical fiber to a roadside display 60 or recorder 62. In addition, ELF waves from an ELF transceiver, such as that described with reference to FIG. 2, may be forwarded to a remotely located ELF receiver/transmitter 64. As noted above, ELF receiver/transmitter 64 might be located on a passing vehicle and/or at a roadside location. Vehicle data may also be transmitted via radio frequency (RF) waves to a remote location by a transmitter 66. One such transmitter is disclosed in the previously cited U.S. Pat. No. 4,302,746.

The advantages of the present invention are numerous. A single point installed detector provides vehicle speed, length and presence. The increased DC magnetic sensitivity provided by the present invention will be useful in detecting both older (more magnetic) vehicles and newer (less magnetic) vehicles. The detector may further be utilized to aid in vehicle classification. Finally, although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A highway vehicle sensing system comprising:

vehicle speed and length detection means including first and second matched induction coil magnetic sensors maintained at or near a roadway surface, each of said sensors having a longitudinal axis aligned normal to the roadway surface, said sensors being separated from one an oher by a known distance in a direction substantially aligned with a direction of traffic flow, each of said sensors generating a differential magnetic field signature with respect to time to indicate a passing vehicle's leading and trailing edge magnetic signatures, wherein said leading and trailing edge magnetic signatures are used in conjunction with said known distance to determine vehicle speed and vehicle length; and vehicle presence detection means, including a triaxial magnetometer maintained at a location in close proximity to said first and second sensors, for measuring a DC magnetic field at said location to determine vehicle presence, said DC magnetic field having vertical and horizontal magnetic field components with said horizontal components including a component substantially aligned with the direction of traffic flow and a component substantially perpendicular to the direction of traffic flow, wherein said vertical and horizontal components caused by the passing vehicle are used to determine vehicle presence.

2. A system as in claim 1 wherein said vehicle speed and length detection means further includes timing means for determining a first, second and third time interval, said first time interval occurring between the passing vehicle's leading edge magnetic signatures detected by said first and second sensors, said second time interval occurring between the passing vehicle's trailing edge magnetic signatures detected by said first and second sensors, and said third time interval occurring between the passing vehicle's leading and trailing edge magnetic signatures detected by one of said first and second sensors, wherein said vehicle speed is determined by a time-distance relationship using at least one of said first and second time intervals and said known distance, and wherein said vehicle length is determined by a time-speed relationship using said third time interval and said determined vehicle speed.

3. A system as in claim 1 wherein said vehicle presence detection means further includes means for nulling out the earth's ambient magnetic field along each of said vertical and horizontal components.

4. A system as in claim 1 wherein said known distance is a fraction of the passing vehicle's length.

5. A system as in claim 1 wherein said known distance is six inches or less.

6. A system as in claim 1 wherein said location in close proximity to said first and second sensors is within six inches of said first and second sensors.

7. A system as in claim 2 further including first and second identical bandpass filters for receiving and passing to said timing means that portion of each sensor's generated differential magnetic field signature containing the passing vehicle's leading and trailing edge magnetic signatures.

8. A system as in claim 1 wherein said triaxial magnetometer is ring-core fluxgate magnetometer.

9. A highway vehicle sensing and communication system comprising:

a transceiver for transmitting extremely low frequency (ELF) signals to a remote location and receiving ELF signals from the remote location, said transceiver including first and second matched induction coil magnetic sensors maintained at or near a roadway surface, each of said sensors having a longitudinal axis aligned normal to the roadway surface, said sensors being separated from one another by a known distance in a direction substantially aligned with a direction of traffic flow, each of said sensors further generating a differential magnetic field signature with respect to time to indicate the passing vehicle's leading and trailing edge magnetic signatures;

a triaxial magnetometer maintained at a location in close proximity to said first and second sensors, for measuring a DC magnetic field at said location, said DC magnetic field having vertical and horizontal magnetic field components with said horizontal components including a component substantially aligned with the direction of traffic flow and a component substantially perpendicular to the direction of traffic flow; and processing means for determining a first, second and third time interval, said first time interval occurring between the passing vehicle's leading edge magnetic signatures detected by said first and second sensors, said second time interval occurring between the passing vehicle's trailing edge magnetic signatures detected by said first and second sensors, and said third time interval occurring between the passing vehicle's leading and trailing edge magnetic signatures detected by one of said first and second sensors, wherein vehicle speed is determined by a time-distance relationship using one at least of said first and second time intervals and said known distance, vehicle length is determined by a time-speed relationship using said third time interval and said determined vehicle speed, and vehicle presence is determined by said vertical and horizontal components caused by the passing vehicle.

10. A system as in claim 9 further including means for nulling out the earth's ambient magnetic field along each of said vertical and horizontal components.

11. A system as in claim 9 wherein said known distance is a fraction of the passing vehicle's length.

12. A system as in claim 9 wherein said known distance is six inches or less.

13. A system as in claim 9 wherein said location in close proximity to said first and second sensors is within six inches of said first and second sensors.

14. A system as in claim 9 further including first and second identical bandpass filters for receiving and passing to said processing means that portion of each sensor's generated differential magnetic field signature containing the passing vehicle's leading and trailing edge magnetic signatures.

15. A system as in claim 9 wherein said triaxial magnetometer is ring-core fluxgate magnetometer.

16. A highway vehicle sensing and communication system comprising:

first and second matched induction coil magnetic sensors maintained at or near a roadway surface, each of said first and second sensors having a longitudinal axis aligned normal to the roadway surface, said first and second sensors being separated from one another by a known distance in a direction substantially aligned with a direction of traffic flow, each of said first and second sensors further generating a differential magnetic field signature with respect to time to indicate the passing vehicle's leading and trailing edge magnetic signatures;

third and fourth matched induction coil magnetic sensors maintained at or near the roadway surface in close proximity to said first and second sensors, each of said third and fourth sensors lying in a unique horizontal plane and having a longitudinal axis aligned substantially parallel to the roadway surface, said third and fourth sensors forming an orthogonal crossing pattern when viewed with respect to a direction normal to the roadway surface, said orthogonal crossing pattern arranged so that each of said third and fourth sensor's longitudinal axis bisects the direction of traffic flow by an angle of approximately 45°, wherein said third and fourth sensors transmit extremely low frequency (ELF) signals to the passing vehicle and receive ELF signals from the passing vehicle;

a triaxial magnetometer, maintained at or near the roadway surface in close proximity to said first through fourth sensors, for measuring a DC magnetic field thereat, said DC magnetic field having vertical and horizontal magnetic field components with said horizontal components including a component substantially aligned with the direction of traffic flow and a component substantially perpendicular to the direction of traffic flow; and processing means for determining a first, second and third time interval, said first time interval occurring between the passing vehicle's leading edge magnetic signatures detected by said first and second sensors, said second time interval occurring between the passing vehicle's trailing edge magnetic signatures detected by said first and second sensors, and said third time interval occurring between the passing vehicle's leading and trailing edge magnetic signatures detected by one of said first and second sensors, wherein vehicle speed is determined by a time-distance relationship using at least one of said first and second time intervals and said known distance, vehicle length is determined by a time-speed relationship using said third time interval and said determined vehicle speed, and vehicle presence is determined by said vertical and horizontal components caused by the passing vehicle.

17. A system as in claim 16 further including means for nulling out the earth's ambient magnetic field along each of said vertical and horizontal components.

18. A system as in claim 16 wherein said known distance is a fraction of the passing vehicle's length.

19. A system as in claim 16 wherein said known distance is six inches or less.

20. A system as in claim 16 wherein said triaxial magnetometer is within six inches of said first through fourth sensors.

21. A system as in claim 16 further including first and second identical bandpass filters for receiving and passing to said processing means that portion of said first and second sensors generated differential magnetic field signature containing the passing vehicle's leading and trailing edge magnetic signatures.

22. A system as in claim 16 wherein said triaxial magnetometer is ring-core fluxgate magnetometer.

23. In a highway vehicle detection system for determining vehicle presence, vehicle speed and vehicle length, an improved detector for installation in a roadway surface comprising:

first and second matched induction coil magnetic sensors maintained at or near the roadway surface, each of said sensors having a longitudinal axis aligned normal to the roadway surface, said first and second sensors being separated from one another by a known distance in a direction substantially aligned with a direction of traffic flow, each of said first and second sensors generating a differential magnetic field signature with respect to time to indicate a passing vehicle's leading and trailing edge magnetic signatures, wherein first, second and third time intervals associated with said leading and trailing edge magnetic signatures are used in conjunction with said known distance to determine vehicle speed and vehicle length, said first time interval occurring between the passing vehicle's leading edge magnetic signatures detected by said first and second sensors, said second time interval occurring between the passing vehicle's trailing edge magnetic signatures detected by said first and second sensors, and said third time interval occurring between the passing vehicle's leading and trailing edge magnetic signatures detected by one of said first and second sensors, wherein said vehicle speed is determined by a time-distance relationship using at least one of said first and second time intervals and said known distance, and wherein said vehicle length is determined by a time-speed relationship using said third time interval and said determined vehicle speed; and a triaxial magnetometer maintained at a location in close proximity to said first and second sensors, for measuring a DC magnetic field at said location to determine vehicle presence, said DC magnetic field having vertical and horizontal magnetic field components with said horizontal components including a component substantially aligned with the direction of traffic flow and a component substantially perpendicular to the direction of traffic flow, wherein said vertical and horizontal components caused by the passing vehicle are used to determine vehicle presence.

24. An improved detector as in claim 23 wherein said known distance is a fraction of the passing vehicle's length.

25. An improved detector as in claim 23 wherein said known distance is six inches or less.

26. An improved detector as in claim 23 wherein said location in close proximity to said first and second sensors is within six inches of said first and second sensors.

27. An improved detector as in claim 23 wherein said triaxial magnetometer is ring-core fluxgate magnetometer.

28. An improved detector as in claim 23 further comprising third and fourth matched induction coil magnetic sensors maintained at or near the roadway surface in close proximity to said first and second sensors, each of said third and fourth sensors lying in a unique horizontal plane and having a longitudinal axis aligned substantially parallel to the roadway surface, said third and fourth sensors forming an orthogonal crossing pattern when viewed with respect to a direction normal to the roadway surface, said orthogonal crossing pattern arranged so that each of said third and fourth sensor's longitudinal axis bisects the direction of traffic flow by an angle of approximately 45°, wherein said third and fourth sensors transmit extremely low frequency (ELF) signals to the passing vehicle and receive ELF signals from the passing vehicle.

29. An improved detector as in claim 28 wherein said third and fourth sensors lie between said first and second sensors.

30. An improved detector as in claim 28 wherein said first through fourth sensors and said triaxial magnetometer span a distance along the direction of traffic flow that is a fraction of the passing vehicle's length.

31. An improved detector as in claim 30 wherein said distance span is six inches or less.

* * * * *